US009599372B2

(12) United States Patent
Bancroft et al.

(10) Patent No.: US 9,599,372 B2
(45) Date of Patent: Mar. 21, 2017

(54) CURVED VORTEX TUBE

(71) Applicants: Mathew E. Bancroft, Christchurch (NZ); Adam S. Lawlor, Perth (AU); Elizabeth A. Gordon, Dunedin (NZ); Adrian P. Taylor, Annerley (AU); William C. Hamill, Christchurch (NZ)

(72) Inventors: Mathew E. Bancroft, Christchurch (NZ); Adam S. Lawlor, Perth (AU); Elizabeth A. Gordon, Dunedin (NZ); Adrian P. Taylor, Annerley (AU); William C. Hamill, Christchurch (NZ)

(73) Assignee: RPB Safety, LLC, Royal Oak, MI (US)

( * ) Notice: Subject to any disclaimer, the term of this patent is extended or adjusted under 35 U.S.C. 154(b) by 1036 days.

(21) Appl. No.: 13/669,347

(22) Filed: Nov. 5, 2012

(65) Prior Publication Data

US 2014/0123978 A1 May 8, 2014

(51) Int. Cl.

| | |
|---|---|
| ***F25B 9/04*** | (2006.01) |
| ***A62B 18/04*** | (2006.01) |
| ***A62B 7/02*** | (2006.01) |
| ***A62B 9/00*** | (2006.01) |
| ***A42B 3/28*** | (2006.01) |

(52) U.S. Cl.

CPC ..... *F25B 9/04* (2013.01); *A42B 3/285* (2013.01); *A62B 9/003* (2013.01); *A62B 18/04* (2013.01)

(58) Field of Classification Search

None

See application file for complete search history.

(56) References Cited

U.S. PATENT DOCUMENTS

| | | | | | |
|---|---|---|---|---|---|
| 2,819,590 | A * | 1/1958 | Green | B64D 13/06 | 128/204.15 |
| 2,893,214 | A * | 7/1959 | Hendal | F25B 9/04 | 62/5 |
| 3,103,104 | A * | 9/1963 | Shackson | A41D 13/0053 | 62/5 |
| 3,898,978 | A * | 8/1975 | Marcus | B63C 11/28 | 126/204 |
| 4,333,017 | A * | 6/1982 | O'Connell | C02F 1/16 | 290/2 |
| 5,558,069 | A * | 9/1996 | Stay | F02M 31/10 | 123/541 |
| 5,560,810 | A * | 10/1996 | Capetanopolous | G01N 33/0016 | 204/408 |
| 2008/0029624 | A1 * | 2/2008 | Shkolnikov | B05B 5/10 | 239/690 |

* cited by examiner

*Primary Examiner* — Tan-Uyen (Jackie) T Ho
*Assistant Examiner* — Joseph D Boecker
(74) *Attorney, Agent, or Firm* — Thomas Coester Intellectual Property

(57) ABSTRACT

A vortex tube with an arcuate hot leg. A vortex tube include a vortex chamber couple to a first tube, a cold leg, to carry a cold air stream and a second tube, the hot leg, to cause the separation of hot and cold air. The hot leg bends in an arc to allow a longer and more efficient hot leg in reduced linear space.

8 Claims, 8 Drawing Sheets

CURVED VORTEX TUBE

BACKGROUND

Field of the Invention

Embodiments of the invention relate to vortex tubes. More specifically, embodiments of the invention relate to vortex tubes having an arcuate hot leg.

Background

The vortex tube was invented in 1933 by French physicist George Ranque and improved in 1947 by Rudolph Hilsch. Thus, vortex tubes are also known as the Ranque-Hilsch vortex tube. In general, a vortex tube is a mechanical device that separates compressed fluid into hot and cold air streams. It has no moving parts, and does not rely on electricity or chlorofluorocarbons etc. to achieve the temperature separation. Vortex tubes are commonly used in spot cooling applications.

Fluid that rotates about an axis in a cyclonic effect is called a vortex. A vortex tube creates a vortex from compressed air and separates it into two air streams, one hot and one cold. The compressed air is injected into a cylinder perpendicular to the longitudinal axis. The cylinder (also referred to as a vortex chamber) is proportionally larger in diameter than either the hot leg (which is the long leg) or the cold leg (the short leg) and both legs are generally coaxial and collinear with the vortex chamber.

The injection of air into the vortex chamber causes it to rotate at high speed. When the rotating air is forced down the inner walls of the hot leg at the distal end a small portion of the air exits through a valve as the hot air stream. The remaining air is forced back through the center of the incoming stream at a slower speed. The heat in the slow moving air is transferred to the faster moving air traveling down the outer portions of the tube thus resulting in a cool airstream which passes back through the center of the vortex chamber and out the cold leg through a cold air exhaust port. In general, the longer (up to about 0.5 meters) the hot leg the greater the temperature separation, that is the difference in temperature between the hot stream and the cold stream. Unfortunately, in many applications, the such long legs would make the use of the vortex tube impractical. As a result, many commercial vortex tubes have relatively short hot legs and suffer from reduced cooling capabilities.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

FIG. 3B is a sectional diagram of the key of FIG. 3A in a steady state orientation.

DETAILED DESCRIPTION

Figure 1:
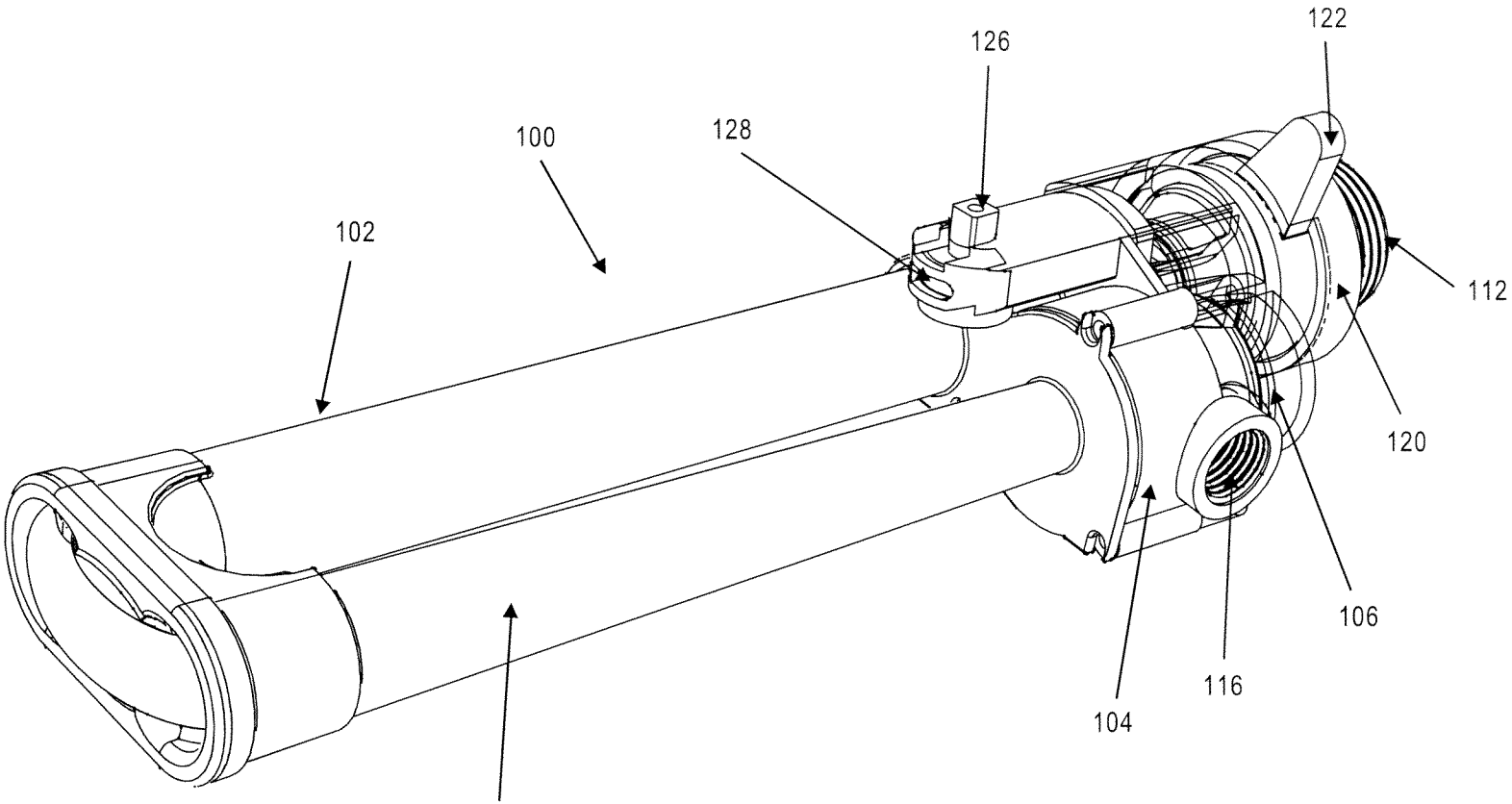
FIG. 1 is a diagram of a vortex tube having an arcuate hot leg in accordance with one embodiment of the invention.

FIG. 1 is a diagram of a vortex tube having an arcuate hot leg in accordance with one embodiment of the invention. Vortex tube assembly 100 includes a vortex chamber 104 coaxial with a cold leg 106. In this embodiment hot leg 102 originates coaxially with vortex chamber 104 but is arcuate defining a generally U-shape having a radius of curvature typically in the range of 0.5 to 10 times the diameter of the tube at the point of curvature. The U-shaped hot leg 102 terminates in valve, which permits the portion of the air flowing in the hot leg to pass into mixer 120. By recirculating (before it leaves the hot leg) a large portion of the air back along the U-shaped leg, the cold stream is formed. The cold stream passes through the center of the vortex chamber and out the cold leg 106. In one embodiment, valve (214 in FIG. 2) is constitutes as a pair of small outlet orifices defined in the end wall of the hot leg. The ratio between the hot end outlet orifice areas and the hot leg cross sectional area is desirably in the range of 0.15 to 0.45. In one embodiment this ratio is 0.30.

Cold leg 106 is also coupled through mixer 120. Mixer 120 controls the relative portions of hot and cold air flowing out the outlet port 112 by virtue of for example, splitter 122 internally to blocks or allows to pass more or less of the respective streams that enter the mixer 120. In one embodiment, splitter 122 permits a mixture of cold and hot from entirely cold to entirely hot. The mixer 120 directs a portion of the air to the outlet port 112 and the remainder to an exhaust port 128. Flow from the exhaust port 128 is controlled by exhaust valve 126. Exhaust valve 126 may be a ball valve, needle valve, check valve or any valve suitable for controlling fluid flow. The exhaust valve is designed to provide cold mass fraction in the range of 0.2 to 0.9. That is 20% to 90% of the exhausted airstreams (that is the aggregate of the stream from the exhaust valve 126 and the stream from outlet port 112) is sourced from the cold leg 106. The exhaust port 128 is positioned on the assembly 100 to point away from a user when used for personnel cooling applications.

An inlet port 116 permits the introduction of compressed air perpendicularly to a long axis of the vortex chamber 104. It is desirable to have the inlet port 116 centered relative to the vortex chamber 104. In the figure, the inlet port 116 is shown as threaded. This threading may receive a nozzle (not shown) to permit coupling to a compresses air source. In some embodiments, the inlet port 116 accommodates nozzles having an internal diameter of 10-15 mm. A vortex inducer (not shown in this figure) is disposed within the vortex chamber 104. The vortex inducer has vanes that encourage the compressed air flowing in through the inlet port 116 to form a vortex and travel down the hot leg 102

By using an arcuate (bent) hot leg 102, the length of the hot leg (and therefore the temperature separation) can be increased while significantly reducing the long dimension of the vortex tube assembly 100. In this U-shaped example, the long dimension of the assembly 100 is approximately half the linear length of the hot leg 102. For embodiments intended for personal use, hot legs having a liner dimension of 300-400 mm are suitable. With this dimension, and a diameter to length ratio of 30-40 (implies a diameter of approximately 10 mm) temperature separations of 80 degrees Celsius are obtainable. While FIG. 1 shows a generally U-shaped hot leg 102, other arcuate arrangements including J-shaped, spiral, FIG. 8, and S-shaped are all within the scope and contemplation of embodiments of the invention.

Figure 2:
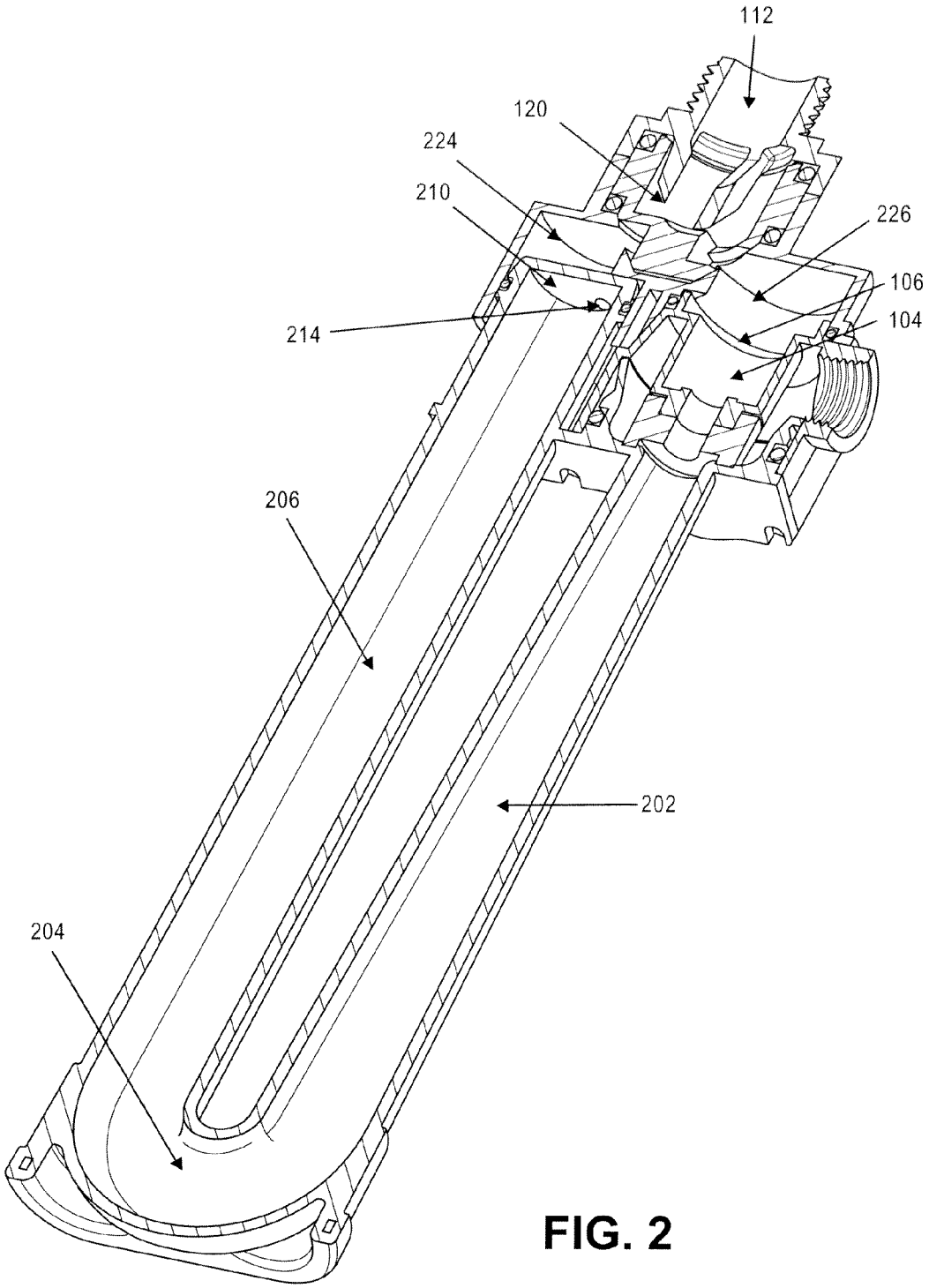
FIG. 2 is a cross sectional diagram of an arcuate vortex tube assembly of an embodiment of the invention.

FIG. 2 is a cross sectional diagram of an arcuate vortex tube assembly of an embodiment of the invention. As revealed in FIG. 2 the hot leg of this embodiment of the vortex tube can be thought of as having three portions. The proximal length 202, the bend 204 and the distal length 206. In one embodiment, proximal length 202 tapers from the bend 204 to vortex chamber 104. That is, proximal length 202 is narrower in diameter where it adjoins the vortex chamber 104 than it is at the bend 204. Conversely, distal length 206 is a substantially uniform diameter along its entire length. Distal length 206 terminates in an end wall 210 that defines the outlet orifices 214 (two in this embodiment; one shown) of the hot leg 102. In one embodiment, the outlet orifices 214 of the hot leg 102 represent an area less than 25% of the area of end wall 210. Additionally, the outlet orifices are defined near the edges of the tube. These characteristics ensure that a large proportion of the airflow will be redirected back through the center of the vortex thereby forming the cold air stream. It is desirable to have the interior walls of the hot leg as smooth as possible as the reduced friction and therefore turbulence within the tube improves temperature separation.

The hot air passing through the outlet orifices enters a hot air antechamber 224, which provides a conduit to the mixer 120. Similarly, the outlet orifice of the cold leg 106 is in fluid communication with a cold antechamber 226 that provides a conduit for the cold air stream to the mixer 120. The cold orifice is generally positioned centrally in a terminal wall of the cold leg 106. The percentage of cold outlet orifice diameter to minimum hot leg diameter is generally in the range of 40%-70%.

An important parameter in the design of the vortex tube is the length to diameter ratio. Generally, as noted above, the longer the hot leg, the better but the length diameter ration should exceed 10 and 25 to 35 is preferred. In general, a range of 10-50 for the length to diameter ratio yields suitable results. It has been found that ratios greater than 55 and/or lengths greater than 1 meter provide no additional benefit. For purposes of the length to diameter calculation the minimum diameter along the hot leg is selected. In one embodiment, the length of the hot leg is in the range of 300-400 mm with an initial diameter of 9.5 mm increasing to 14.6 mm at the bend. The taper angle is 1.5° per side for a 3° taper along its length. With a hot leg of this length, the assembly has a maximum long dimension less than 225 mm.

Figure 3A:
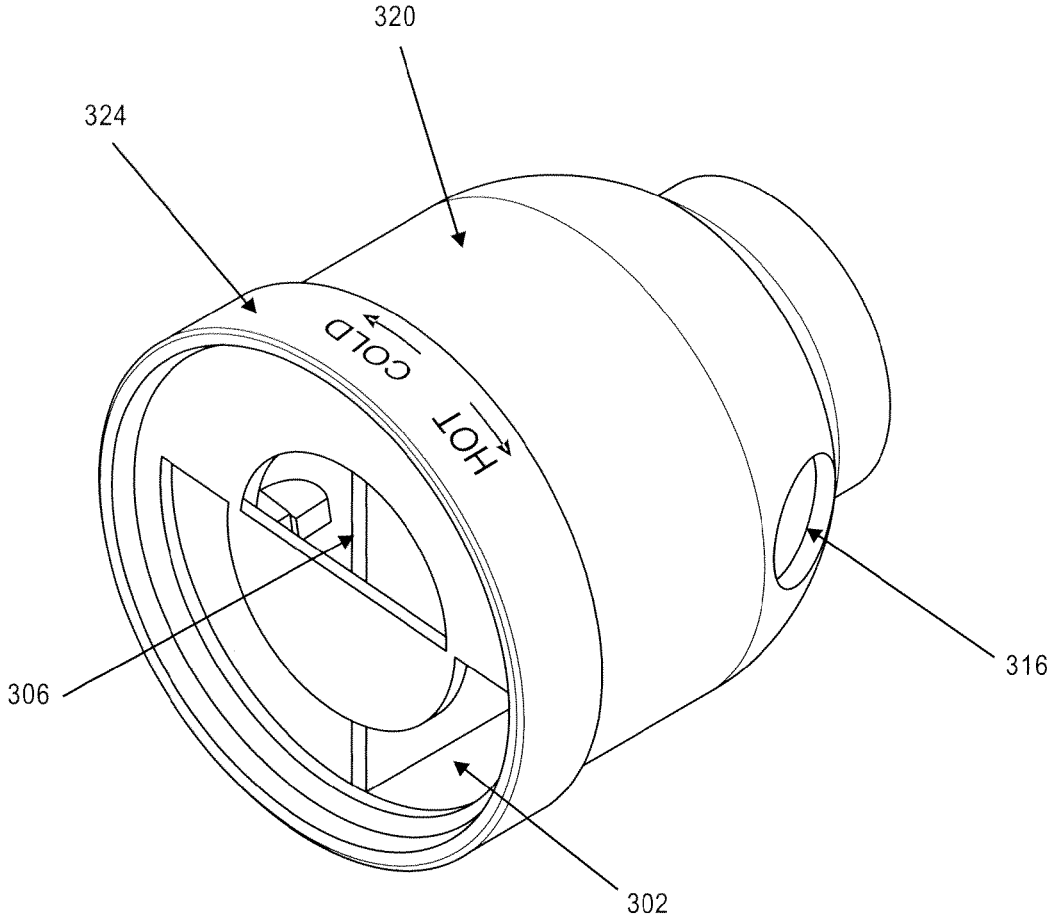
FIGS. 3A and 3B show a mixer of one embodiment of the invention.
Figure 3B:
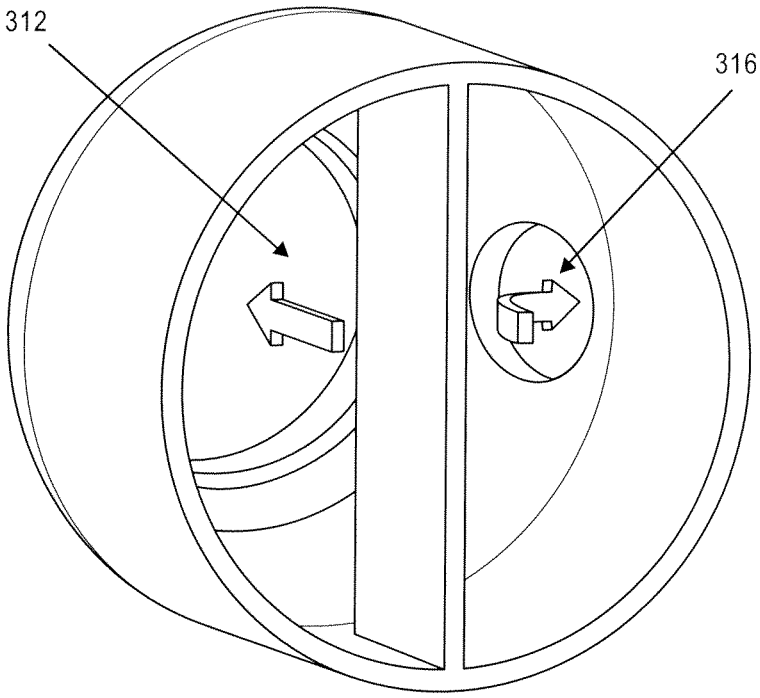

FIGS. 3A and 3B show a mixer of one embodiment of the invention. Mixer 320 includes a temperature control ring 324 which can be rotated to change the split of hot air flow 302 relative to cold airflow 306. A hot air exhaust port 316 is used to exhaust off additional hot air. Then assembled tube hot air exhaust port 316 is oriented away from heat sensitive articles. In the case of the personal vortex tube for use with a respirator, the hot exhaust 316 is oriented away from the user. FIG. 3B shows a back view revealing the outlet port 312 and the hot air exhaust 316. As described above, hot air exhaust is controlled by a valve that is independent of the hot to cold air ratio established by the mixer.

Figure 4:
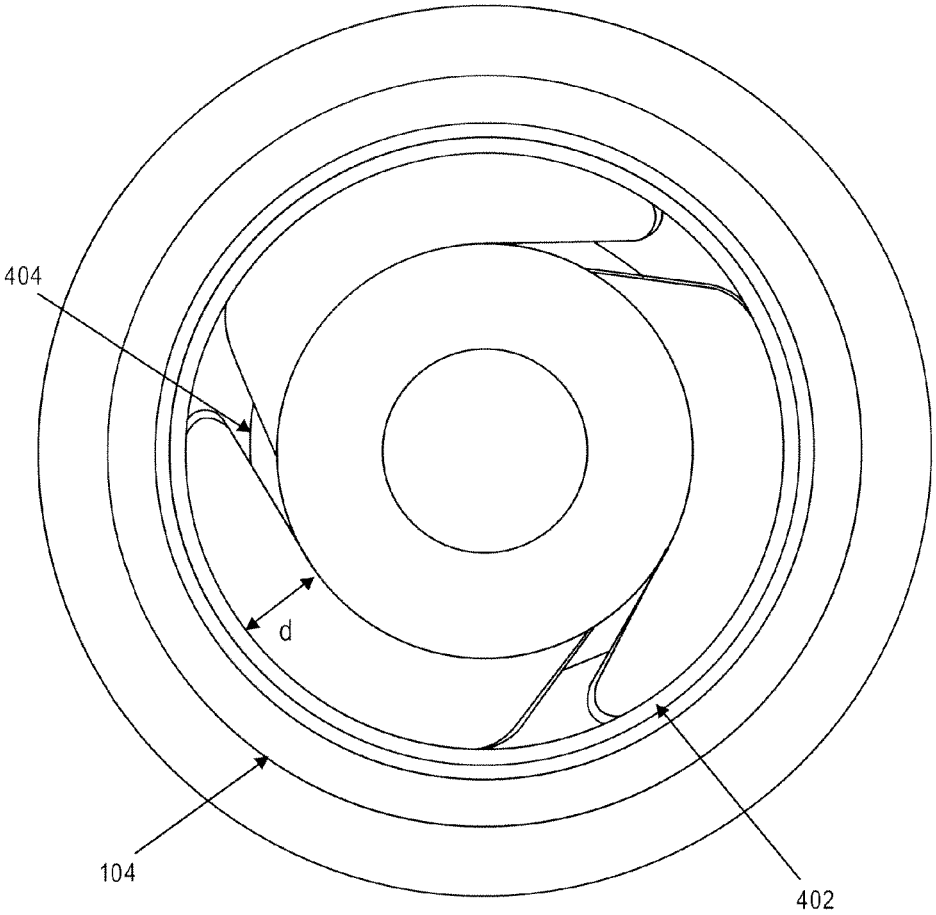
FIG. 4 is a diagram of the vortex inducer within the vortex chamber.

FIG. 4 shows a diagram of the vortex inducer within the vortex chamber. Vortex inducer 402 resides in vortex chamber 104. Vortex inducer 402 has a plurality of vanes 404 that taper over a distance d towards the hot leg. The distance d is typically in the range of 2.4-4 mm. In one embodiment d is approximately 2.6 mm. More generally, d should be in the range of 20-45% of the minimum diameter of the hot leg. The vortex inducer 402 encourages the air entering the inlet port to form a vortex and travel down the hot leg.

Figure 5:
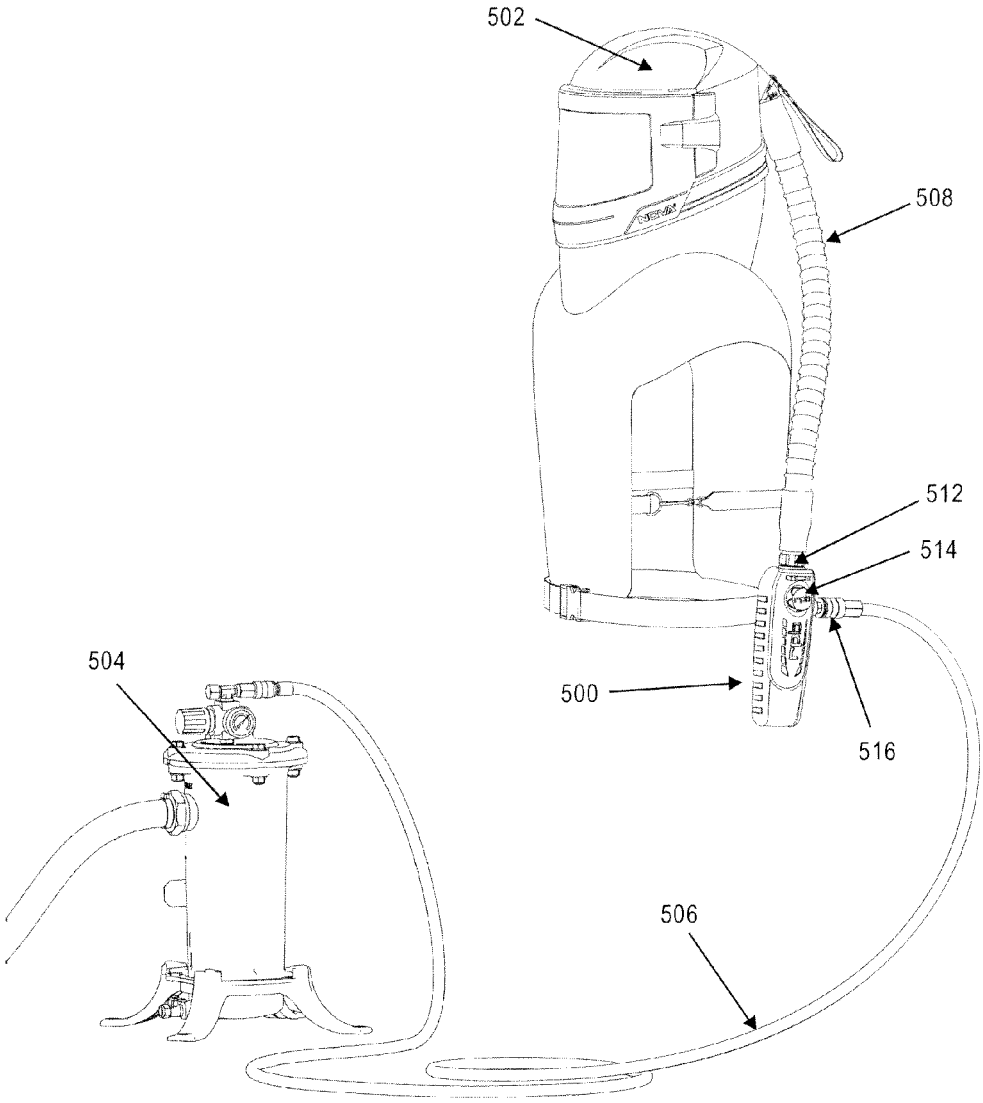
FIG. 5 is a diagram of a system employing one embodiment of the invention.

FIG. 5 is a diagram of a system employing one embodiment of the invention. The compressed air source 506 supplies compressed air via a hose 506 that is coupled to an inlet nozzle of inlet port 516 of vortex tube assembly 500. Vortex tube assembly 500 may be substantially the same as vortex tube assembly of FIG. 1, but is shown with a protective cover that shields a user from temperature extremes in the hot and cold legs and controls the venting of exhaust. Outlet port of vortex tube assembly 500 is coupled to outlet house 508 which in turn may be coupled for example, to a respirator helmet 502 to provide internal cooling to the helmet. Hot air exhaust 514 is positioned to exhaust hot air away from a user or respirator helmet 502. In one embodiment, compressed air source 504 provides compressed air at a minimum flow rate of 200 l/min at 55 psi. Other embodiments may have the flow rate in the range of 110 to 425 l/min and in the range of 40 psi and 80 psi. To provide meaningful cooling, flow rate should exceed 110 l/min at 40 psi. Ata flow rate of 200 l/min and 55 psi the temperature separation of 80° C. can be achieved.

In one embodiment, the vortex tube assembly may be molded in two halves from a suitable thermoplastic. The plastic must be appropriately selected to withstand the pressure and temperature ranges expected to be encountered during use. For example, Acetal has been found to have suitable properties but other thermoset plastics, thermoform plastics or metal could be used. The two halves may then be for example heat welded together. In some embodiments, the cover can be integrally molded with the underlying halves of the vortex tube.

Figure 6:
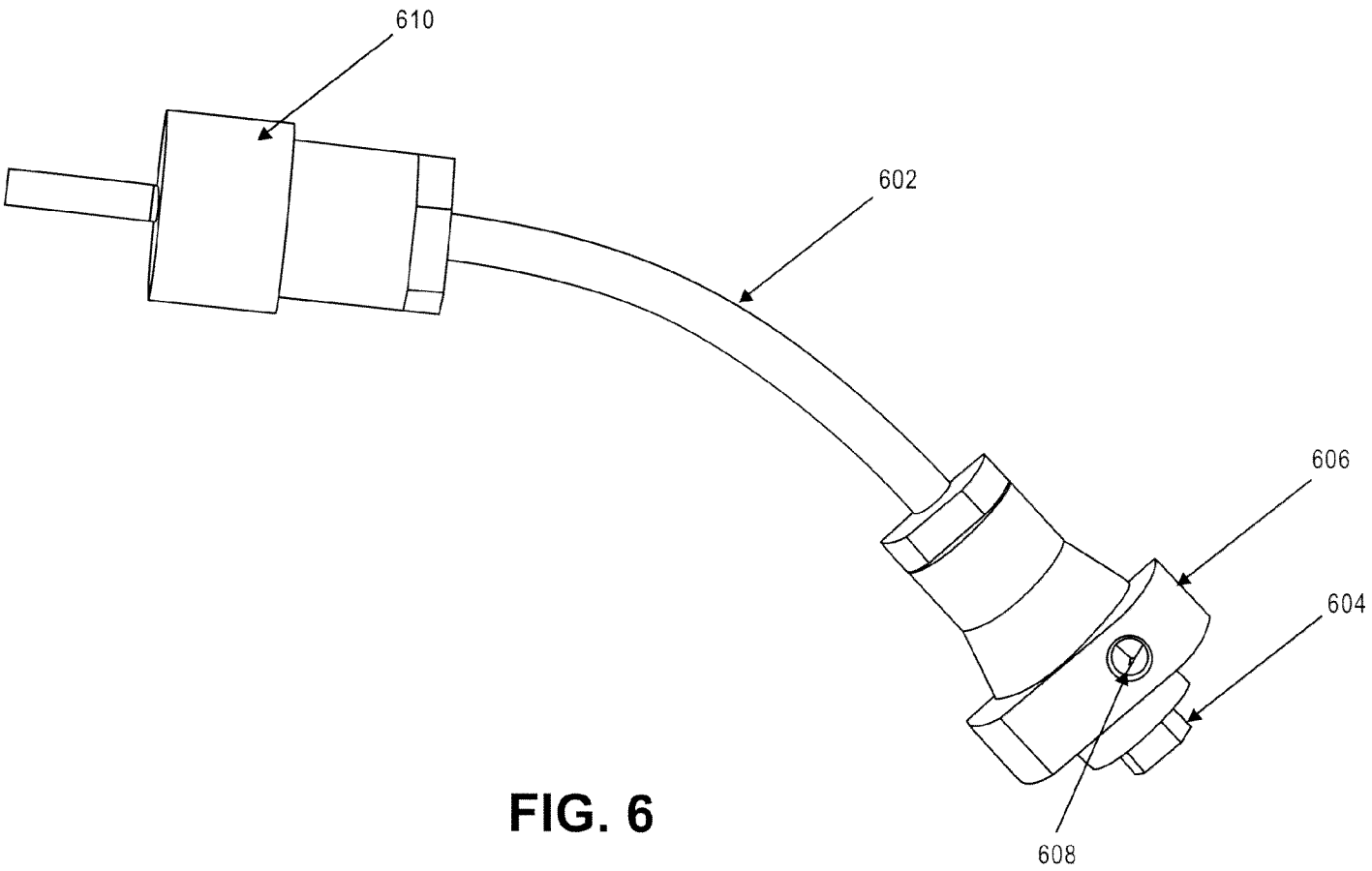
FIG. 6. is a diagram of an embodiment of the invention having a flexible hot leg.

FIG. 6 is a diagram of an embodiment of the invention having a flexible hot leg. Similar to other embodiments described above, a vortex chamber 606 has an inlet port 608 to be attached to a compressed air source. Cold leg 604 emits a cold air stream resulting from separation in the vortex tube. Hot leg 602 is made of a flexible material to permit it to bend through a range of arcs. For example hot leg 602 can be bent into a J or U shape. It may also be bendable into a spiral like a cork screw. This flexible hot leg 602 provides flexibility in positioning the hot outlet relative to the cold outlet and allows use where a rigid device would be impossible or impractical. Hot leg 602 terminates in a valve outlet 610. Dimensionally, hot leg 602 may be in the same range as those described for the hot leg of other embodiments above. Generally, this embodiment may employ similar dimensions and ratios or dimensions as described above.

Figure 7:
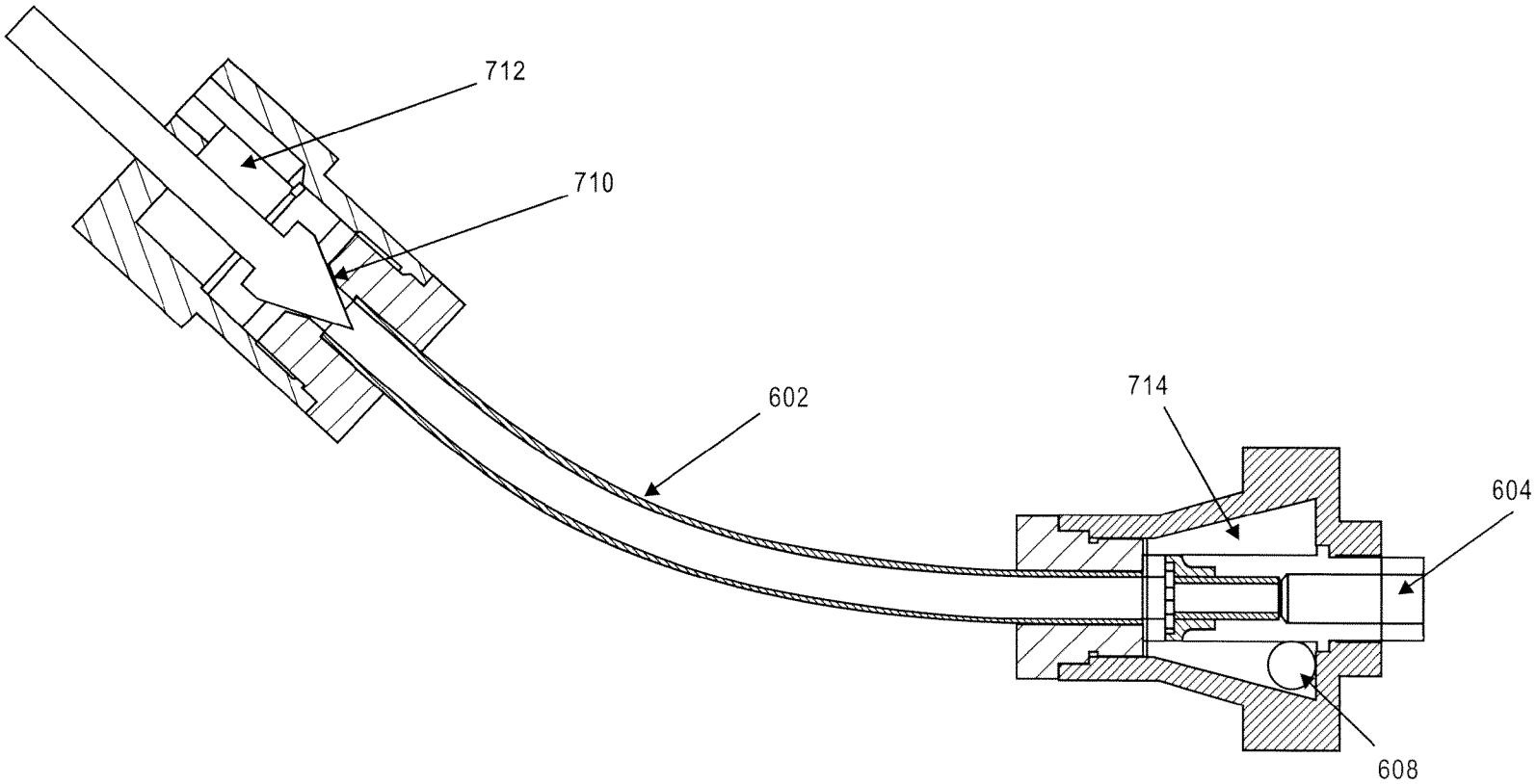
FIG. 7 is a sectional view of the vortex tube having a flexible hot leg of FIG. 6.

FIG. 7 is a sectional view of the vortex tube having a flexible hot leg of FIG. 6. In this view the valve 710 that controls the hot air flow out of hot leg 602 can be seen. Compressed air entering inlet port 608 forms a vortex in the interior 714 of the vortex chamber. The air separates into hot and cold stream with the hot air moving to the outside of the hot leg and the cool air being redirected or turning along the hot leg and exiting through the cold leg 604. The flexible hot leg 602 allows significant flexibility in use environments for the overall vortex tube. In some embodiments it may use as a personal cooling device such as the system shown in FIG. 5. Suitable materials for hot leg 602 include various high density flexible plastics with sufficient heat resistance to not degrade in the presence of the expected temperature range within the vortex tube.

In the foregoing specification, the embodiments of the invention have been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. An apparatus comprising:

a vortex chamber defining an inlet port and a first and second outlet port, the inlet port to be coupled to a compressed fluid supply;

a first outlet tube coupled to the first outlet port of the vortex chamber emitting a cool air flow when the inlet port is supplied with compressed air; and a second outlet tube coupled to the second outlet port and emitting a hot air flow when compressed air is supplied to the inlet port, the second tube defining at least one arc wherein the second outlet tube has a length in the range of 20 to 40 times the smallest diameter of the second outlet tube and the longest dimension of the apparatus is less than 22.5 times the smallest diameter of the second outlet tube.

2. The apparatus of claim 1 wherein the second outlet tube defines a generally U shape.

3. The apparatus of claim 1 wherein the second outlet tube comprises an end wall defining one or more outlet orifices, the outlet orifices having an aggregate area less than 10% of an area of the end wall.

4. The apparatus of claim 1 wherein the arc has a radius of curvature in the range of 0.5 to 10 times the diameter of the tube at the point of curvature.

5. The apparatus of claim 1 further comprising:

a mixer to combine the cool air flow and hot air flow in a user defined ratio, the mixer defining an outlet path and an exhaust path.

6. The apparatus of claim 5 further comprising:

an exhaust valve coupled to the mixer to meter the flow in the exhaust path.

7. The apparatus of claim 1 wherein a diameter of the second outlet tube is tapered along a first portion of its length.

8. The apparatus of claim 7 where in a diameter of the second outlet tube is uniform along a second portion of its length.

* * * * *